US007348947B2

(12) United States Patent
Inukai

(10) Patent No.: US 7,348,947 B2
(45) **Date of Patent: *Mar. 25, 2008**

(54) CIRCUIT, DISPLAY DEVICE, AND ELECTRONIC APPARATUS

(75) Inventor: Kazutaka Inukai, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 621 days.

This patent is subject to a terminal disclaimer.

(21) Appl. No.: 10/745,497

(22) Filed: Dec. 29, 2003

(65) Prior Publication Data

US 2004/0135779 A1 Jul. 15, 2004

(30) Foreign Application Priority Data

Jan. 7, 2003 (JP) ..... 2003-001495

(51) Int. Cl.
*G09G 3/32* (2006.01)

(52) U.S. Cl. ..... 345/82; 345/76

(58) Field of Classification Search ..... 345/76, 345/77, 80, 82, 83, 212; 341/144
See application file for complete search history.

(56) References Cited

U.S. PATENT DOCUMENTS

| | | | | |
|---|---|---|---|---|
| 5,703,582 | A * | 12/1997 | Koyama et al. | 341/120 |
| 6,091,203 | A | 7/2000 | Kawashima et al. | |
| 6,501,466 | B1 | 12/2002 | Yamagishi et al. | |
| 6,639,576 | B2 | 10/2003 | Miyazawa et al. | |
| 6,650,060 | B2 | 11/2003 | Okuda | |
| 6,919,834 | B2 * | 7/2005 | Inukai | 341/144 |
| 2002/0196213 | A1 * | 12/2002 | Akimoto et al. | 345/82 |
| 2003/0102900 | A1 * | 6/2003 | Barrow | 327/309 |
| 2003/0132931 | A1 * | 7/2003 | Kimura et al. | 345/212 |
| 2003/0156102 | A1 | 8/2003 | Kimura | |
| 2004/0135799 | A1 | 7/2004 | Shiomi et al. | |

FOREIGN PATENT DOCUMENTS

| | | |
|---|---|---|
| EP | 1102234 | 5/2001 |
| JP | 2-055421 | 2/1990 |
| JP | 11-282419 | 10/1999 |
| JP | 2001-147659 | 5/2001 |
| JP | 2002-215095 | 7/2002 |

* cited by examiner

*Primary Examiner*—Ricardo Osorio
(74) *Attorney, Agent, or Firm*—Fish & Richardson P.C.

(57) ABSTRACT

A simple DA converter circuit which reads in digital voltage value data and outputs analog current value data is provided. The DA converter circuit according to the invention can be applied, for example, to a data driver circuit of an AM-OLED display device. The DA converter circuit comprises a current output circuit comprising a plurality of drive transistors. Gate electrodes of the transistors are electrically connected to each other, and a switch is provided between the gate electrode and drain electrode of each drive transistor.

13 Claims, 9 Drawing Sheets

CIRCUIT, DISPLAY DEVICE, AND ELECTRONIC APPARATUS

BACKGROUND OF THE INVENTION

1. Field of the Invention

The present invention relates to technologies of a current output circuit and a DA converter circuit, and more particularly to a display device and an electronic apparatus mounted with the current output circuit or the DA converter circuit.

2. Description of the Related Art

In recent years, demand for a thin display device displaying images has been increasing. As the thin display device, a liquid crystal display device displaying images by using a liquid crystal element is widely used in various types of display devices, such as portable telephones and personal computers by utilizing the advantages of the liquid crystal display device such as thin size, high image quality, and light weight.

On the other hand, the development of a thin display device and a light emitting display device using a light emitting element has also been advancing. Such a light emitting element includes various kinds of elements over a wide range, such as an organic material, an inorganic material, a thin film material, a bulk material, and a dispersion material.

An organic light emitting diode (OLED) is a typical light emitting element currently seen as promising for all types of thin display devices. An OLED display device using an OLED element is thinner and lighter than the existing liquid crystal display devices, and in addition, have characteristics such as a high response speed suitable for a moving image display, a wide viewing angle, and a low voltage drive. Therefore, the OLED display device is drawing attention as the next-generation display device since a wide variety of its applications are anticipated, to portable telephones, portable information terminals such as a personal digital assistant (PDA), televisions, monitors, and the like.

In particular, an active matrix (AM) OLED display device realizes a large screen display and high definition which are difficult for a passive matrix (PM) display. Furthermore, the AM-OLED display device operates at lower power consumption than the PM-OLED display device, and has high reliability. Thus, it is strongly expected to be put into practical use. Also, by integrating driver circuits on a panel, a frame region of the panel can be narrowed, thus a display device with a high added value can be obtained. This is another advantage of the AM-OLED display device.

An OLED element is a current drive type element which is structured by an anode, a cathode, and an organic compound containing a layer sandwiched between the anode and the cathode. The brightness of light emitted from the OLED element is roughly proportional to the amount of electric current flowing in the OLED element.

A voltage programming method and a current programming method are used as driving methods for displaying images in AM-OLED display devices. The voltage programming method is a method in which a video signal of voltage value data is inputted to pixels as an input video signal. On the other hand, the current programming method is a method in which a video signal of current value data is inputted to pixels as an input video signal. Generally, in the AM-OLED display devices, the current programming method tends to be preferably used.

The current programming method is preferably used in the light of the display quality. In a pixel of the AM-OLED display device, a pixel drive transistor controlling brightness of light emitted from an OLED element of the pixel is connected in series with the OLED element in both voltage and current programming methods. In the voltage programming method, a voltage of a video signal is normally applied directly to a gate electrode of a pixel drive transistor. Therefore, if there is variation, not uniformity, in the electrical characteristics of the pixel drive transistors across each of the pixels when the OLED elements emit light at a constant current, (then) the variation will develop in the current for driving the OLED element of each of the pixels. Variation in the current for driving the OLED element becomes variation in the brightness of light emitted from the OLED element. Further, variation in the brightness of light emitted by the OLED element reduces the quality of the displayed image as a sandstorm state or carpet-like pattern unevenness is seen over an entire screen.

In particular, polycrystalline silicon (polysilicon) TFTs are used as the pixel drive transistors at present for obtaining a sufficient current required for high brightness, which can not be obtained by using amorphous silicon thin film transistors (TFTs) as the pixel drive transistors. However, there is a problem with polysilicon TFTs in that variation in the TFT electrical characteristics are likely to develop due to faults in the crystal grain boundaries and the like.

Although the current programming method is suited for the AM-OLED display device than the voltage programming method in general, it has problems. One of the problems is that the configuration of its driver circuit is comparatively complicated than that of the voltage programming type, thus is more difficult to be integrated on a panel.

SUMMARY OF THE INVENTION

A panel configuration of a typical AM-OLED display device of a current programming type is described below with reference to FIGS. 7 to 9 and FIG. 4.

FIG. 9 is a configuration diagram of an entire panel. Generally, in addition to a pixel portion 931 which has pixels arranged in matrix, a gate driver circuit 921 and a data driver circuit 911 are integrally formed on a panel. A dashed line portion 913 in the data driver circuit 911 denotes a selector circuit. Dotted line portions 912*a* and 912*b* in FIG. 9 denote current data output circuits, whose configurations are shown in a dotted line portion 842 in FIG. 8.

The current data output circuit shown in FIG. 8 can be roughly divided into the following four groups: a shift register unit, a digital data latch unit, a current source (current output circuit), and DA (Digital-to-Analog) switches. The current source (current output circuit) and the DA switches jointly constitute a current output DA converter circuit.

Reference numbers 801 to 803 correspond to the shift register unit. The reference number 803 denotes clock and its inverted signal lines, and 801 to 802 denote checker portions. Each of the checker portions 801 and 802 is configured with a circuit 403 shown in FIG. 4. The shift register unit sequentially generates and outputs timing signals. In accordance with these timing signals, video data (digital data) is read into the digital data latch unit from a data signal line.

Reference numbers 811 to 818 correspond to the digital data latch unit. The reference number 817 denotes a data signal line for each bit, 818 denotes a latch signal line, and 815 to 816 denote checker portions. Each of the checker portions 815 and 816 is configured with the circuit 403 shown in FIG. 4. In FIG. 8, three data signal lines are provided on the assumption that video data (digital data) is of a 3-bit-constitution, and the checker portions 815 and 816 are omitted for simplicity in 812 and 813. The video data (digital data) read in accordance with the timing signals from the shift register unit is transferred to DA switches 821 to 823 in synchronism with latch signals.

A dotted portion 824 corresponds to the current source (current output circuit), and its specific circuit configuration is shown in a dotted portion 791 in FIG. 7. The current source corresponding to each bit is provided independently. That is to say, a current source circuit which is configured with 701, 711, 721, 731, and 741 is totally independent of a current source circuit which is configured with 702, 712, 722, 732, and 742.

Reference numbers 821 to 823 in FIG. 8 corresponding to the DA switches are denoted by 761 to 763 in FIG. 7. Since the DA switches are connected to each other in parallel, the total current of the current sources of all the bits whose DA switches are in ON states is outputted from the current data output circuit in the end.

At the outside of the panel, video data is processed most efficiently when the data is processed as digital voltage data. In this respect, the current output DA converter circuit in the current data output circuit in FIG. 8 serves for the data processing favorably. However, in a DA converter, a current value for each bit has to be set individually, thus it makes the operation complicated. In addition, an increase in the number of bits causes an increase in the number of input lines for setting current, and complexity and expansion of a layout.

An object of the invention is to provide a simple DA converter circuit which reads in digital voltage value data and outputs analog current value data. The invention can be applied to a data driver circuit used for a current programming type AM-OLED display device.

The invention includes a current output circuit which comprises a plurality of drive transistors, wherein gate electrodes of the drive transistors are electrically connected to each other, and a switch is provided between the gate electrode and drain electrode of each drive transistor.

The invention includes a current output DA converter circuit which comprises the current output circuit comprising a plurality of drive transistors, wherein a switch whose ON/OFF operation is controlled corresponding to bit data is provided at each drain of the drive transistors.

In addition, the invention includes display devices and electronic apparatuses to which the current output circuit or the current output DA converter circuit is applied.

The invention includes a current output circuit which comprises a plurality of drive transistors, wherein gate electrodes of the drive transistors are electrically connected to each other, and a switch is provided between the gate electrode and drain electrode of each drive transistor. By utilizing a current output circuit of the invention, a simple DA converter circuit which reads in digital voltage value data and outputs analog current value data can be provided. The invention can be applied to a data driver circuit used for a current programming type AM-OLED display device and the like.

DETAILED DESCRIPTION OF THE PREFERRED EMBODIMENTS

Preferred embodiments of the invention will be hereinafter described referring to the accompanying drawings.

Embodiment Mode 1

An embodiment of the invention is explained below with reference to FIGS. 10, 12, 4, and 1. In this embodiment, a DA converter circuit of the invention is applied to a data driver circuit of an AM-OLED display device. 3-bit digital voltage value data is read in as video data here, however, it is needless to mention that, there is no limitation in the number of bits processed in the DA converter circuit of the invention.

Figure 10:
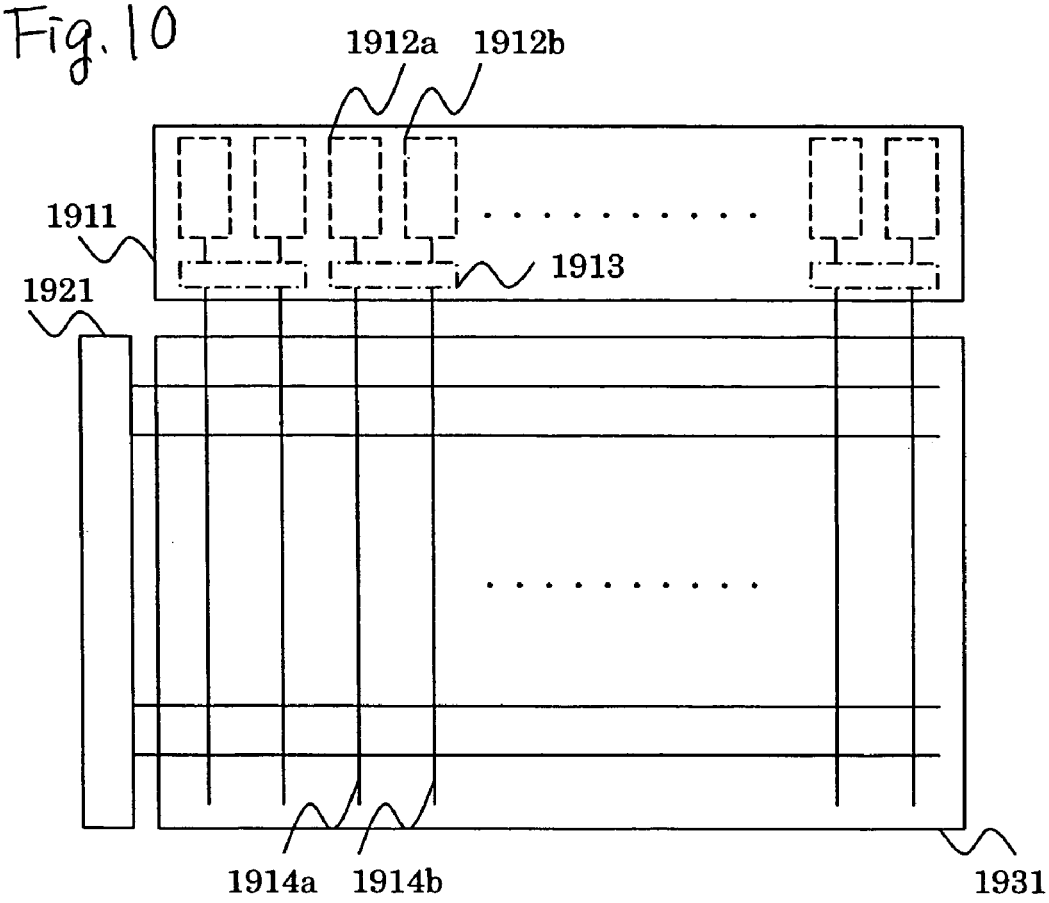
FIG. 10 is a diagram showing a configuration example of a panel of a display device of the invention.

FIG. 10 is a configuration diagram of an entire panel. A pixel portion 1931 where pixels are arranged in matrix, a gate driver circuit 1921, and a data driver circuit 1911 are integrally formed on the panel. A dashed line portion 1913 in the data driver circuit 1911 denotes a selector circuit. Dotted line portions 1912*a* and 1912*b* denote current data output circuits, whose configurations are shown by a dotted line portion 1842 in FIG. 12.

Described below is the dotted line portion 1842 shown in FIG. 12 corresponding to the current data output circuits 1912*a* and 1912*b*, and follows a description of the selector circuit 1913 in FIG. 10.

Figure 12:
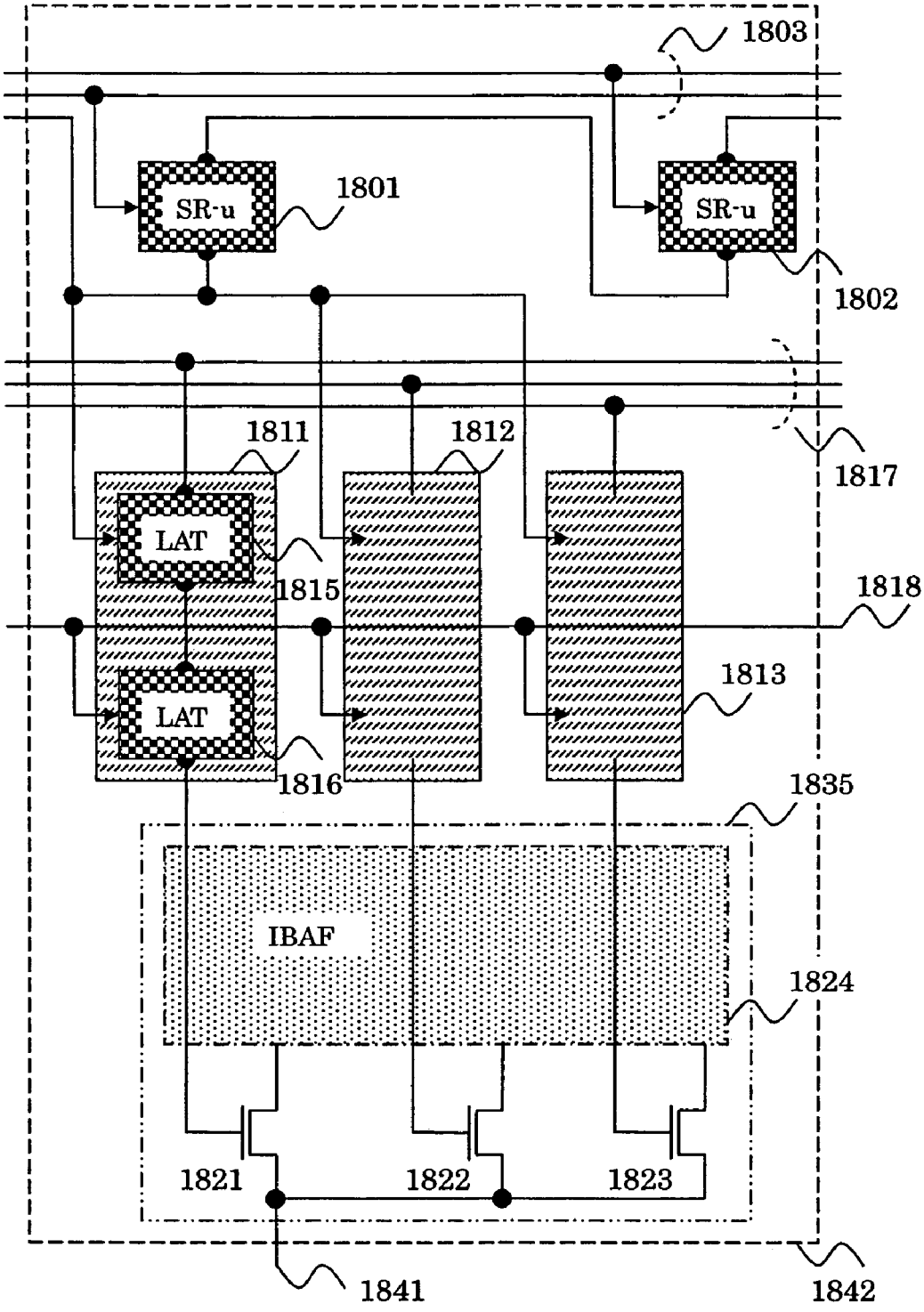
FIG. 12 is a configuration example of a data driver using a DA converter circuit of the invention.

The current data output circuit 1842 in FIG. 12 can be roughly divided into the following four groups: a shift register unit, a digital data latch unit, a current source (current output circuit), and DA switches. The current source (current output circuit), and the DA switches jointly constitute a current output DA converter circuit.

Reference numbers 1801 to 1803 correspond to the shift register unit. The shift register unit includes clock and its inverted signal lines 1803, and checker portions 1801 and 1802. Each of the checker portions 1801 and 1802 is configured, for example, with a circuit 403 shown in FIG. 4. It is to be noted that, the configurations of the checker portions 1801 and 1802 are not exclusively limited to the circuit 403. Other circuits can be substitutes for them as long as they can implement the same functions.

The shift register unit 1801 to 1803 sequentially generates and outputs timing signals. In accordance with these timing signals, video data (digital data) is read into the digital data latch unit from data signal lines.

Reference numbers 1811 to 1818 correspond to the digital data latch unit. The digital data latch unit includes a data signal line 1817 for each bit, a latch signal line 1818, and checker portions 1815 and 1816. Each of the checker portions 1815 and 1816 may be configured with the circuit 403 shown in FIG. 4. In FIG. 12, three data signal lines are provided on the assumption that video data (digital data) is of a 3-bit-constitution, and the checker portions 1815 and 1816 are omitted for simplicity in 1812 and 1813. The video data (digital data) read in accordance with the timing signals from the shift register unit is transferred to DA switches 1821 to 1823 in synchronism with latch signals.

Figure 1:
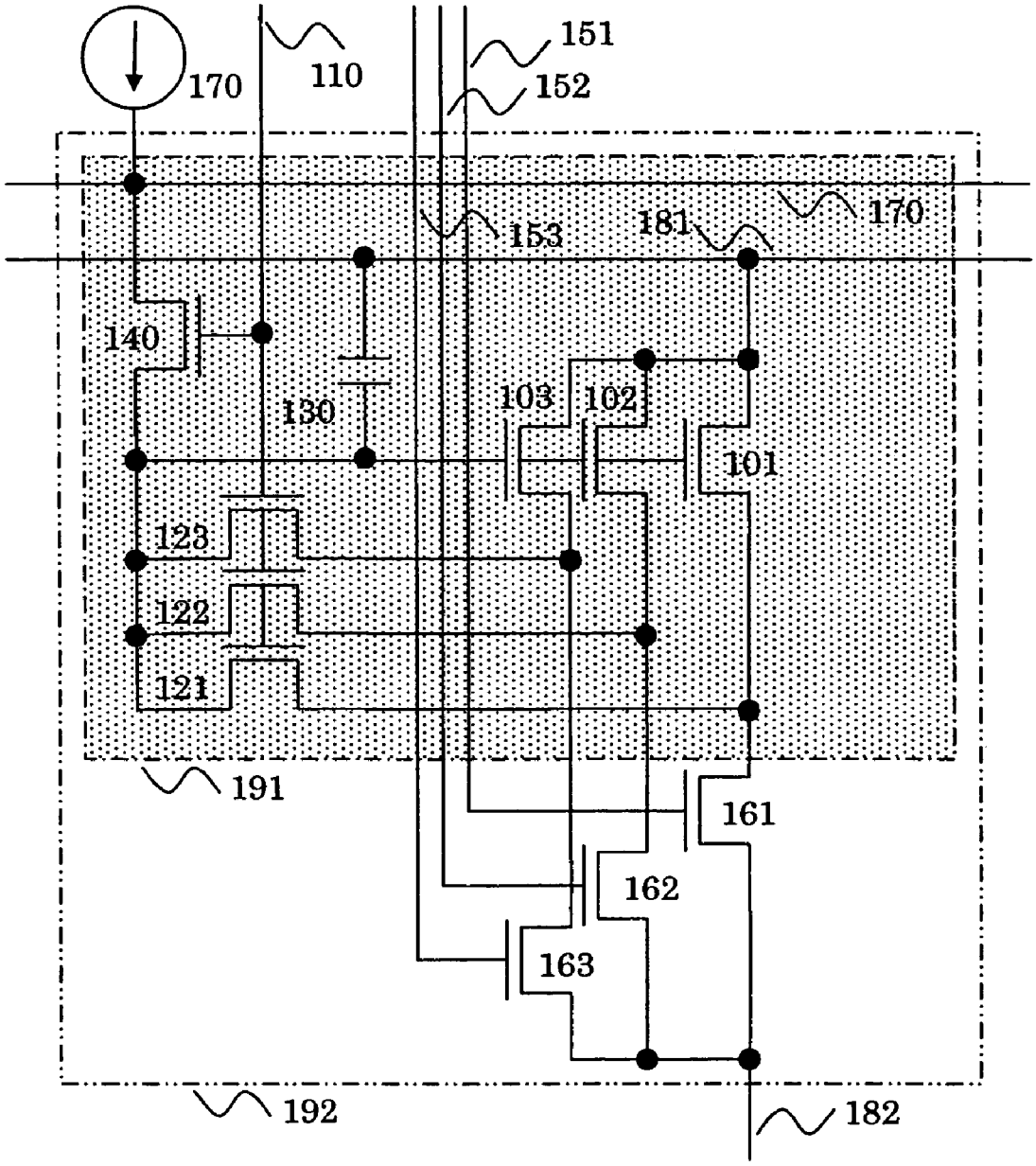
FIG. 1 is a diagram showing a configuration example of a current output circuit and a DA converter circuit of the invention.

A dotted portion 1824 corresponds to the current source (current output circuit) and its specific circuit configuration is shown in a dotted portion 191 in FIG. 1. Transistors 101 to 103 are drive transistors. Transistors 161 to 163 correspond the DA switches. These DA switch transistors correspond to 1821 to 1823 in FIG. 12.

Figure 7:
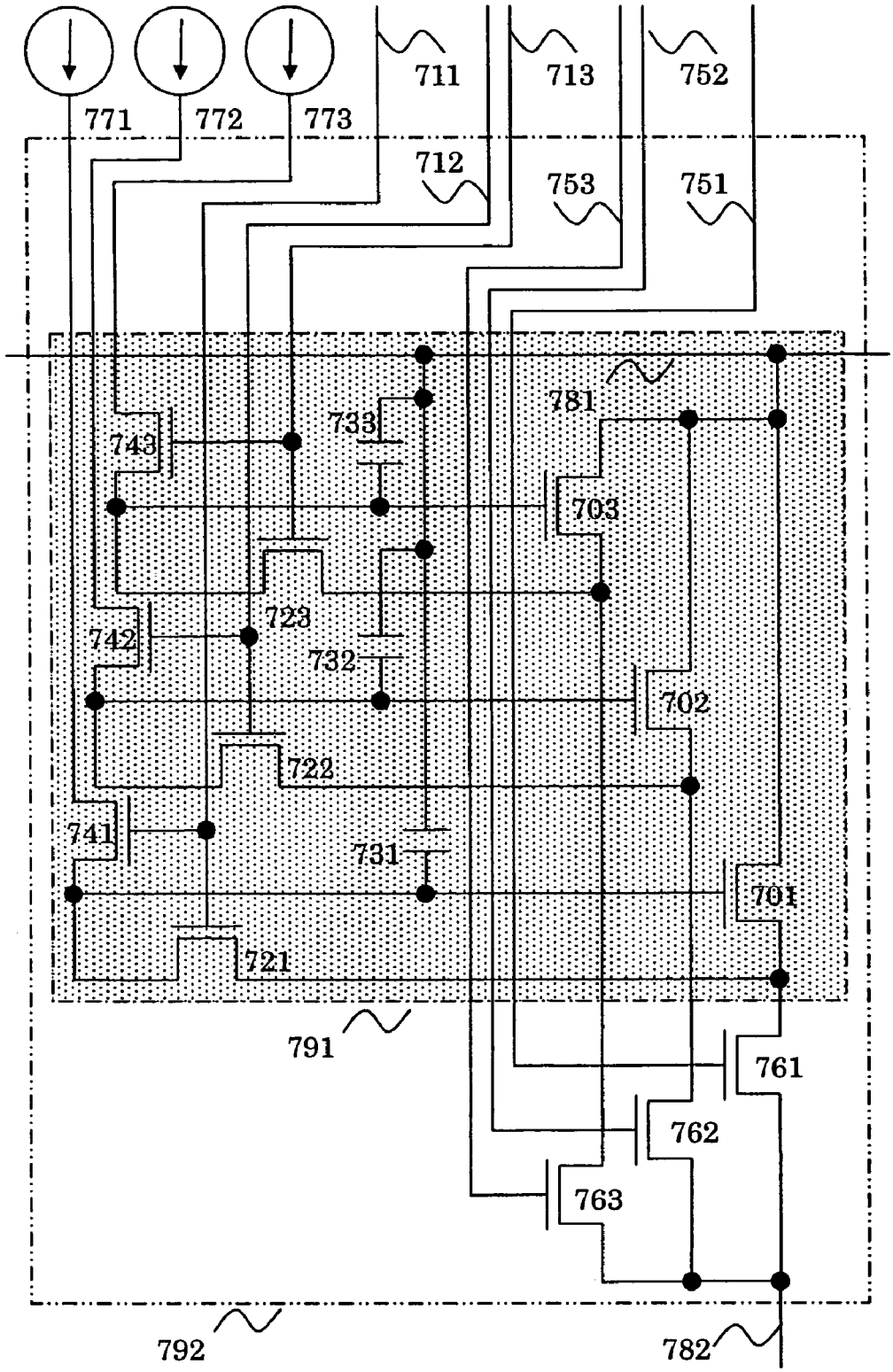
FIG. 7 is a diagram showing a conventional current output circuit and a DA converter circuit.
Figure 8:
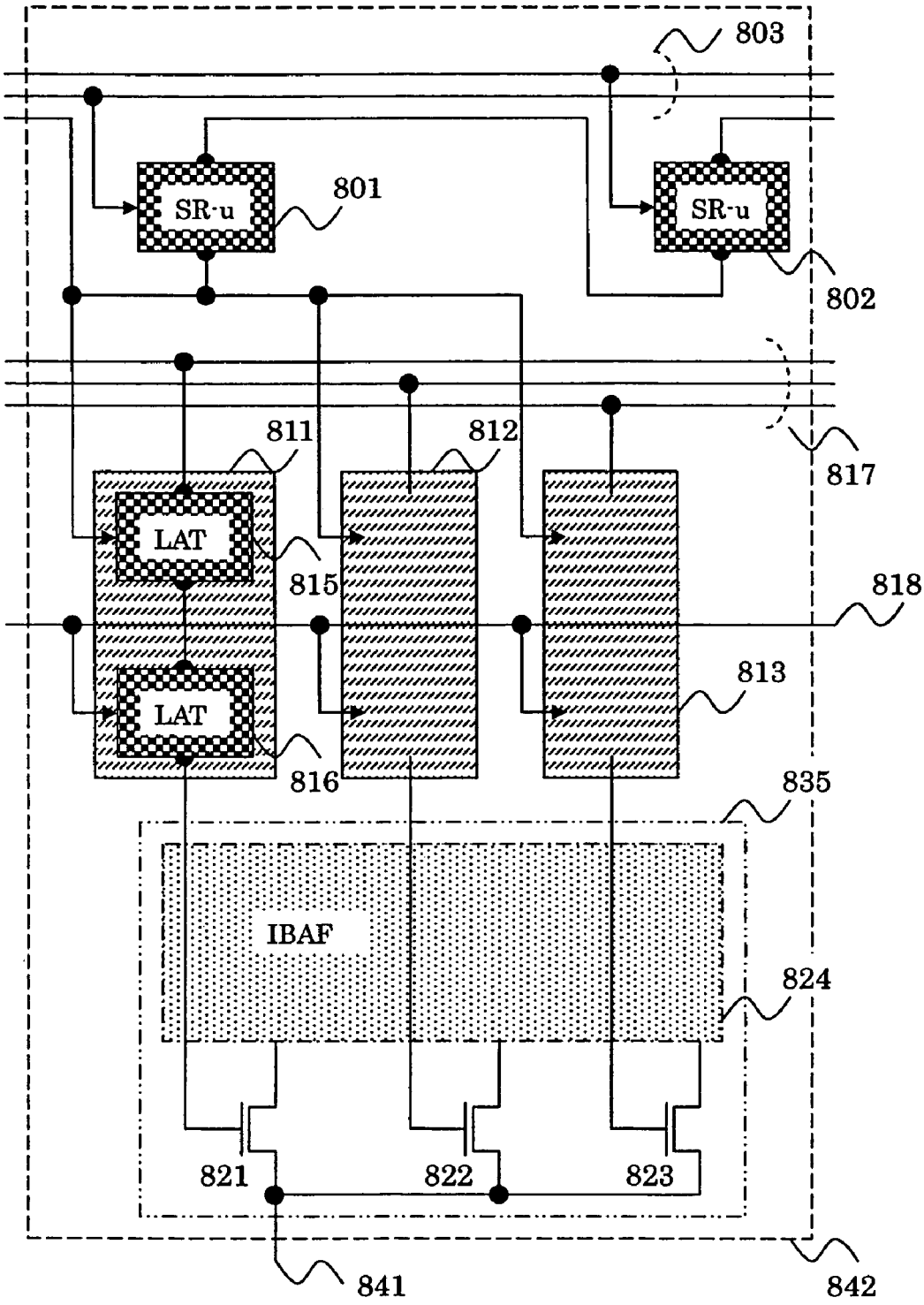
FIG. 8 is a diagram showing a configuration example of a data driver using a DA converter circuit.

In FIG. 1, the drive transistor corresponding to each bit is provided independently. For example, a transistor 101 is for the first bit (MSB: the Most Significant Bit), 102 for the second bit, and 103 for the third bit (LSB: the Least Significant Bit). The L/W size ratio of the three drive transistors is set about at 1:2:4. However, as each gate electrode of the drive transistors 101 to 103 are electrically connected to each other, it is possible to set a reference current for each drive transistor at the same time. In this respect, the circuit shown in FIG. 1 is different from that shown in FIG. 7. Furthermore, the circuit shown in FIG. 1 serves to reduce the circuit area since it has less transistors and wirings than that of the circuit shown in FIG. 7.

Operation for setting a reference current at the current source (current output circuit) is explained below.

For setting a reference current, signals which turn OFF the DA switch transistors 161 to 163 are inputted from digital signal input lines 151 to 153. When the transistors 161 to 163 are n-channel types, Low (low voltage) signals are inputted to them. However, the transistors 161 to 163 do not need to be turned OFF when there is no possibility of a current leaking from an output portion 182 such as a case where an end of the output portion 182 is electrically released (in high impedance).

Next, a signal which turns ON the transistors 121 to 123, and 140 is inputted from a current-setting signal input line current-setting signal input line 110. When these transistors are n-channel types, Hi (high voltage) signals are inputted to them. Then, a current flows from a reference current source 170 through a constant voltage source 181. At this time, the gates and drains of the drive transistors 101 to 103 are each short-circuited. Therefore, when a signal which turns OFF the transistors 121 to 123, and 140 is inputted from the current-setting signal input line 110 after the current becomes a stationary value, the reference current is stored as each gate voltage of the drive transistors 101 to 103.

A reference current is set through the above-mentioned steps. However, as a small current is leaked from the gate nodes of the drive transistors 101 to 103, the reference current needs to be set (periodically or non-periodically).

After the completion of setting the reference current, digital voltage signals corresponding to video signals are inputted from the digital signal input lines 151 to 153. The digital signal input lines 151 to 153 correspond to a data input portion of the current output DA converter circuit 192. Since the DA switch transistors 161 to 163 are connected in parallel, the total current of the current sources of all the bits whose DA switches is in ON states is outputted from the output portion 182 in the end. In this manner, digital voltage value data is converted into an analog current.

In the current output DA converter circuit 192 shown in FIG. 1, if there is variation in the drive transistors 101 to 103 in respect to electrical characteristics such as threshold voltages and electric field effect mobility, a display of middle gradation may be inaccurate. However, by setting the reference current as above, an accurate display of the maximum gradation can be obtained.

In the current output DA converter circuit 192 shown in FIG. 1, reference currents for all the bits are set at the same time. Therefore, the setting is performed with a less complex manner than those in the circuit 792 shown in FIG. 7 in which a reference current for each bit has to be set individually.

Shown in FIG. 1 is an example of a DA converter circuit which reads in 3-bit digital voltage value data, and outputs analog current value data. However, in the case of reading in N-bit digital voltage value data (N is the arbitrary integer number not less than 2), the similar configuration can be employed.

Meanwhile, the drive transistors 101 to 103 are n-channel types and the constant voltage source 181 is a low voltage source in the example shown in FIG. 1. However, the similar configuration can also be employed when the drive transistors 101 to 103 are p-channel types and 181 is a high voltage source. Furthermore, other configurations can also be employed as long as they include a current output circuit comprising a plurality of drive transistors, wherein gate electrodes of the drive transistors are electrically connected to each other, and a switch is provided between the gate electrode and drain electrode of each drive transistor.

Figure 3:
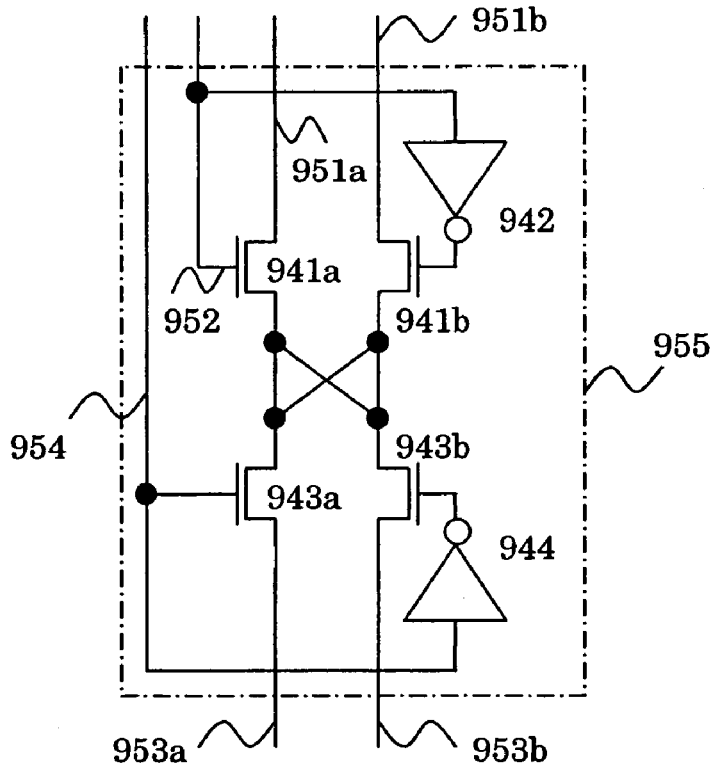
FIG. 3 is a diagram showing a configuration example of a selector circuit.
Figure 4:
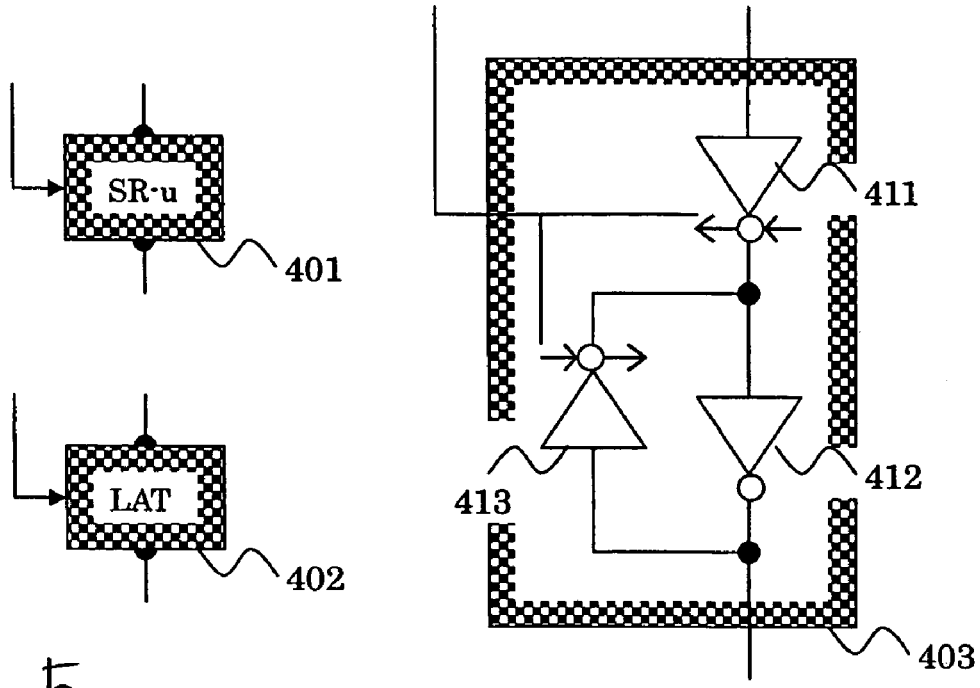
FIG. 4 is a diagram showing a configuration example of a latch circuit.

At the outside of the panel, video data is processed most efficiently when the data is processed as digital voltage data. In this respect, the current output DA converter circuit 192 shown in FIG. 1 or 1835 shown in FIG. 12 in the current data output circuit in FIG. 3 serves for the data processing favorably.

Figure 2:
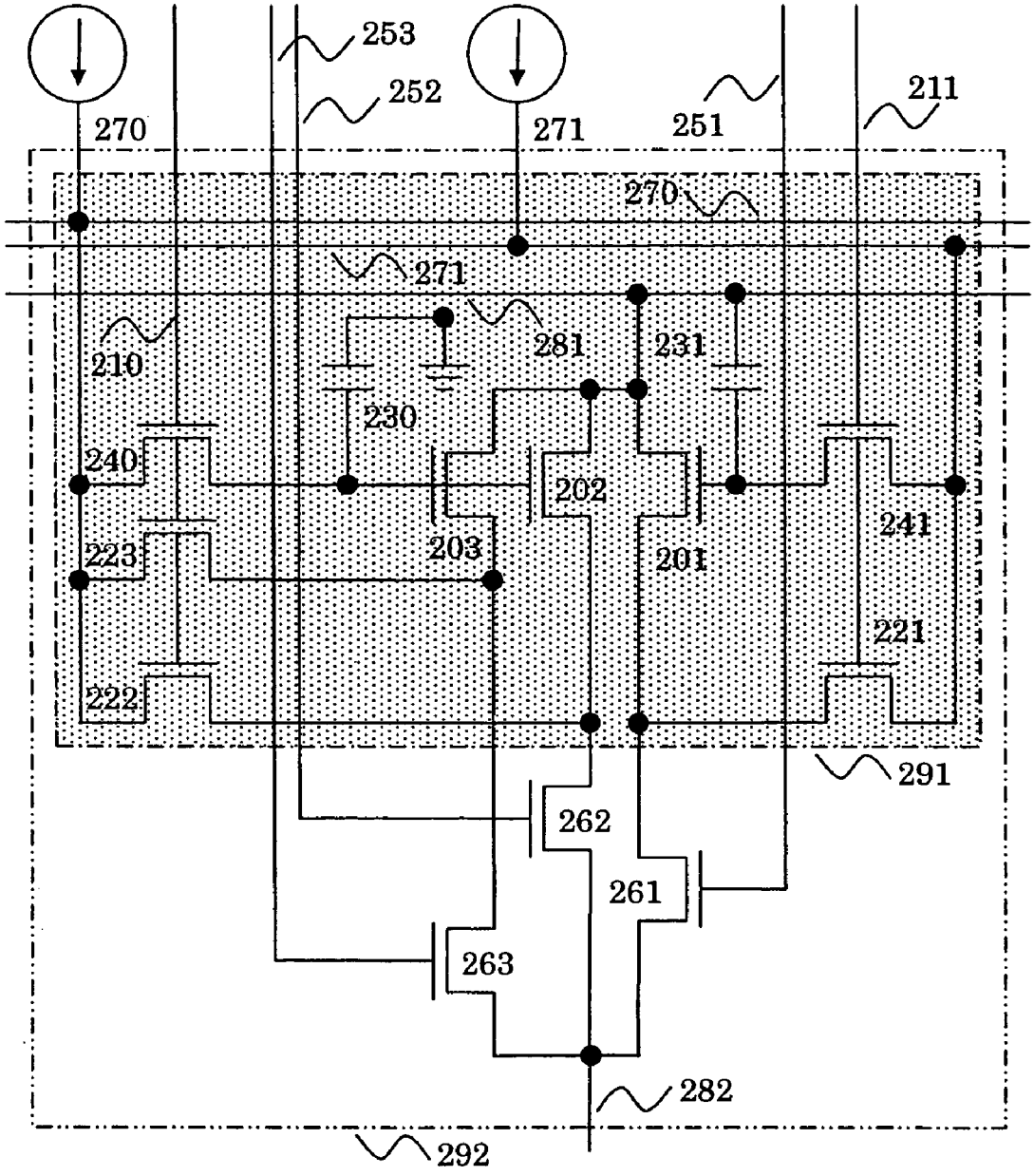
FIG. 2 is a diagram showing a configuration example of a current output circuit and a DA converter circuit of the invention.
Figure 9:
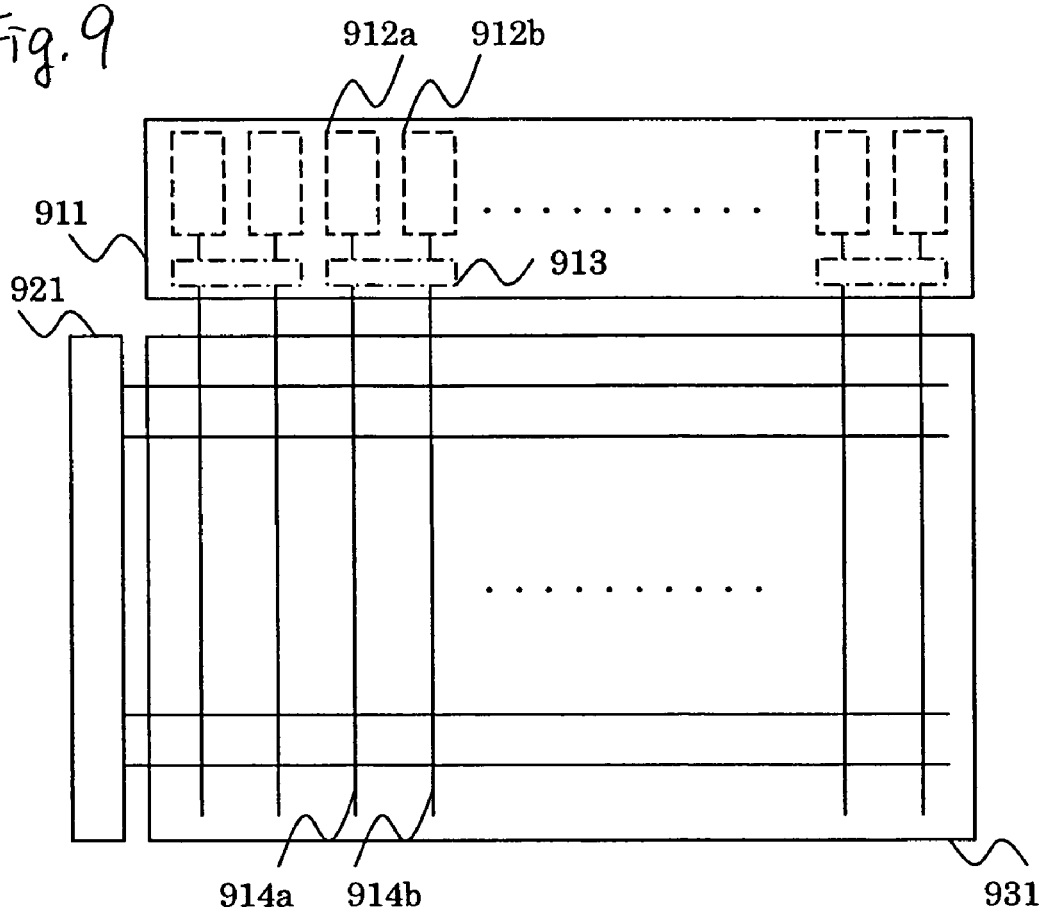
FIG. 9 is a diagram showing a configuration example of a panel of a display device.

However, when the analog current to be outputted is 0 or very small, it takes a long time to set the current by using the current output DA converter circuit shown in FIG. 2 only. In order to overcome this inconvenience, the current data output circuit 1842 may be additionally provided with a pre-charge circuit.

Figure 11:
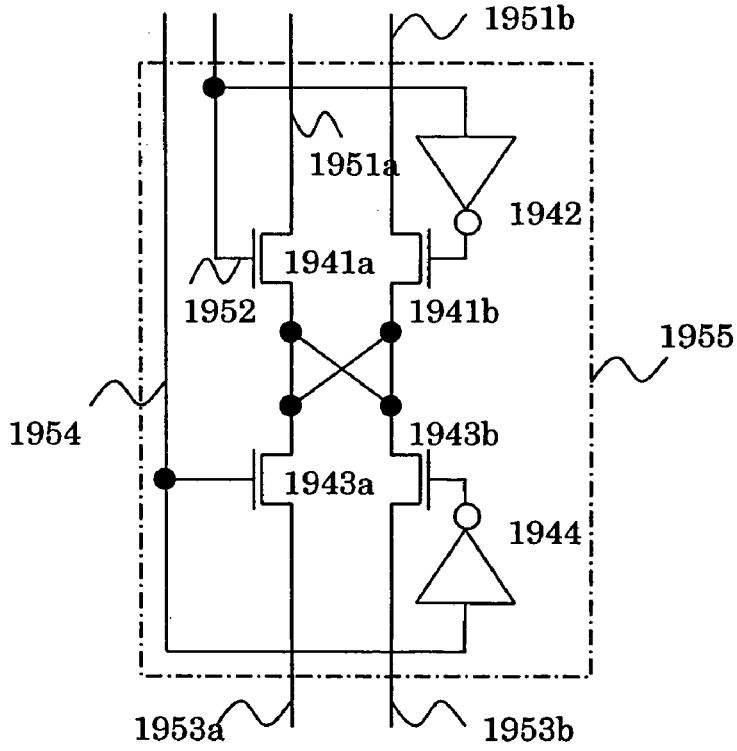
FIG. 11 is a configuration example of a selector circuit of the invention.

Described above is the current data output circuit 1842 which corresponds to the current data output circuits 1912*a* and 1912*b*. Next, description is made below on the selector circuit 1913. Its circuit configuration is shown in a dashed line portion 1955 in FIG. 11 as a specific example of the selector circuit 1913, however, the configuration is not limited to this.

In the selector circuit 1913 shown in FIG. 10, the output node of the current data output circuit 1912*a* or 1912*b* is switched to a data line 1914*a* or 1914*b*. In FIG. 10, the ratio of the number of current data output circuits to that of data lines is 2:2 per selector circuit, however, other ratios may be also employed in general. An essential point here is that a plurality of current data output circuits can be provided per selector circuit.

By providing a plurality of current data output circuits per selector circuit, it becomes possible to set a reference current at a current source (the dotted portion 191 of FIG. 1) of one current data output circuit, while the other current data output circuits output data. Therefore, time is utilized efficiently.

For example, the current data output circuit 1912*b* may output data while a reference current is set in the current data output circuit 1912*a* at odd frames. Vice versa, the current data output circuit 1912*a* may output data while a reference current is set in the current data output circuit 1912*b* at even frames. Accordingly, time for outputting data and time for setting a reference current need not be provided individually, thus it makes contribution to the timesaving.

The use of the selector circuit 1913 shown in FIG. 10 is advantageous in view of the foregoing, however, it is not essentially provided in the invention. Other configurations may also be employed as a substitute for the selector circuit 1913.

Embodiment Mode 2

Another embodiment mode of the invention is explained below with reference to FIGS. 5, 12, 4, and 2. In this embodiment, a DA converter circuit of the invention is applied to a data driver circuit of an AM-OLED display device. 3-bit digital voltage value data is read in as video data here, however, it is needless to mention that, there is no limitation in the number of bits processed in the DA converter circuit of the invention.

Figure 5:
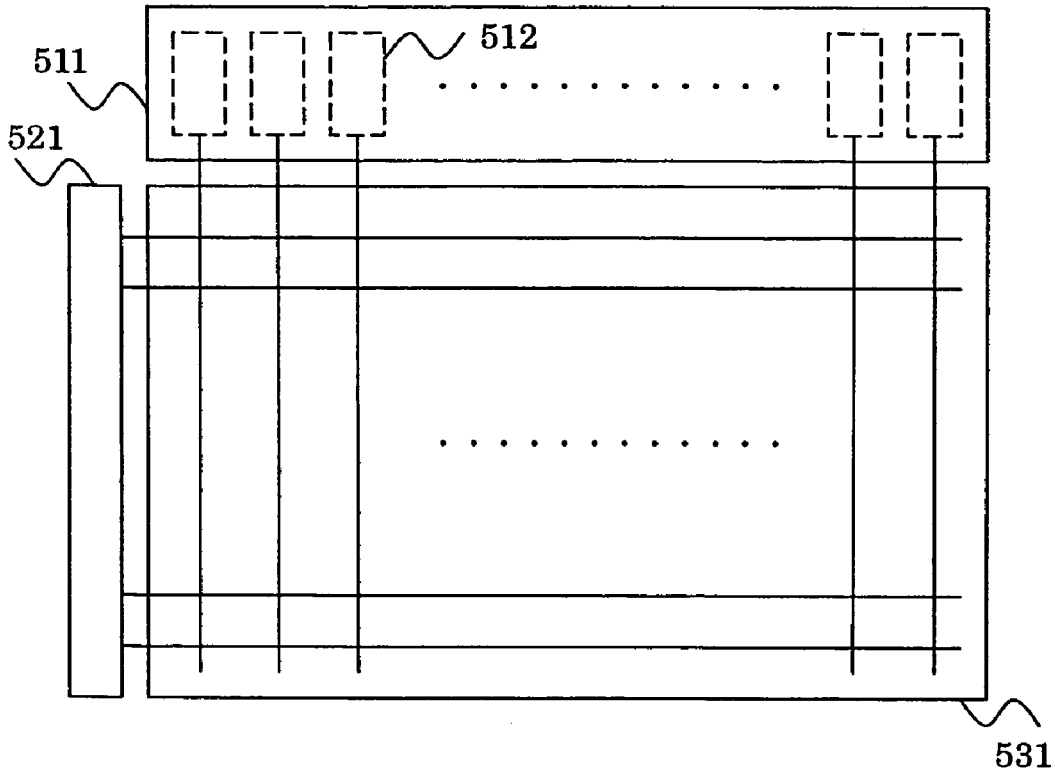
FIG. 5 is a diagram showing a configuration example of a panel of a display device of the invention.

FIG. 5 is a configuration diagram of an entire panel. A pixel portion 531 where pixels are arranged in matrix, a gate driver circuit 521, and a data driver circuit 511 are integrally formed on the panel. A dotted line portion 512 in the data driver circuit 511 is a current data output circuit, whose configuration is shown by a dotted line portion 1842 in FIG. 12. It is to be noted that, a data driver circuit having selector circuits as shown in FIG. 10 may be employed in place of the data driver circuit shown in FIG. 5. However, for ease of description, the configuration of the entire panel of FIG. 5 is employed here.

The dotted line portion 1842 shown in FIG. 12 which corresponds to the current data output circuit 512 is explained below.

The current data output circuit 1842 can be roughly divided into the following four groups: a shift register unit, a digital data latch unit, a current source (current output circuit), and DA switches. The current source (current output circuit) and the DA switches jointly constitute a current output DA converter circuit.

Reference numbers 1801 to 1803 correspond to the shift register unit. The shift register unit includes clock and its inverted signal lines 1803, and checker portions 1801 and 1802. Each checker portion 1801 and 1802 is configured, for example, with a circuit 403 shown in FIG. 4. It is to be noted that, the configurations of the checker portions 1801 and 1802 are not exclusively limited to the circuit 403. Other circuits can be substitutes for them as long as they can implement the same functions.

The shift register unit 1801 to 1803 sequentially generates and outputs timing signals. In accordance with these timing signals, video data (digital data) is read into the digital data latch unit from data signal lines.

Reference numbers 1811 to 1818 correspond to the digital data latch unit. The digital data latch unit includes a data signal line 1817 for each bit, a latch signal line 1818, and checker portions 1815 and 1816. Each of the checker portions 1815 and 1816 may be configured with the circuit 403 shown in FIG. 4. In FIG. 12, three data signal lines are provided on the assumption that video data (digital data) is of a 3-bit-constitution, and the checker portions 1815 and 1816 are omitted for simplicity in 1812 and 1813. The video data (digital data) read in accordance with the timing signals from the shift register unit is transferred to DA switches 1821 to 1823 in synchronism with latch signals.

A dotted portion 1824 corresponds to the current source (current output circuit). Its specific circuit configuration is shown in a dotted portion 291 in FIG. 2.

Transistors 201 to 203 are drive transistors. Transistors 261 to 263 are DA switch transistors and correspond to the DA switches 1821 to 1823 shown in FIG. 12.

In FIG. 2, the drive transistor corresponding to each bit is provided independently. For example, a transistor 201 is for the first bit (MSB), 202 for the second bit, and 203 is for the third bit (ISB). The L/W size ratio of the three transistors is desirably set about at 1:2:4. More generally, the L/W size ratio of the driver transistors is desirably set about at $2^0$: $2^1$: . . . :$2^{n-1}$ (N is the arbitrary integer number not less than 2) by raising to a power of binary.

The gate electrodes of the drive transistors 202 and 203 are electrically connected to each other, thus it is possible to set a reference current for each transistor at the same time. In this respect, the circuit shown in FIG. 2 is different from that shown in FIG. 7. The circuit shown in FIG. 2 serves to reduce the circuit area since it has less transistors and wirings than that of the circuit shown in FIG. 7.

Further, the gate electrode of the drive transistor 201 is not electrically connected to the gate electrodes of the drive transistors 202 to 203. In this respect, the circuit shown in FIG. 2 is also different from that shown in FIG. 1. In the circuit shown in FIG. 2, a reference current for the drive transistor 201 for the first bit (MSB) is set independently of those for other bits. Therefore, a current value of the MSB data is expected to be accurate.

Operation for setting a reference current at the power source (current output circuit) is explained below.

For setting a reference current, signals which turn OFF the DA switch transistors 261 to 263 are inputted from digital signal input lines 251 to 253. When the transistors 261 to 263 are n-channel types, Lo (low voltage) signals are inputted to them. However, when there is no possibility of a current leaking from an output portion 282, such as a case where an end of the output portion 282 is electrically released (in high impedance), the transistors 261 to 263 do not need to be turned OFF.

Next, a signal which turns ON the transistors 222, 223, and 240 is inputted from a current-setting signal input line 210. When these transistors are n-channel types, Hi (high voltage) signal is inputted to them. Then, a current flows from a reference current source 270 through a constant voltage source 281. At this time, the gates and drains of the drive transistors 202 and 203 are each short-circuited. Therefore, when a signal which turns OFF the transistors 222, 223, and 240 is inputted from the 210 after the current becomes a steady value, the reference current for the second and third bits is stored as each gate voltage of the drive transistors 202 to 203.

At the same time, a signal which turns ON transistors 221 and 241 is inputted from a current-setting signal input line 211. When these transistors are n-channel types, Hi (high voltage) signal is inputted to them. Then, a current flows from a reference current source 271 through a constant voltage source 281. At this time, the gate and drain of the drive transistor 201 are short-circuited. Therefore, when a signal which turns OFF the transistors 221 and 241 is inputted from the current-setting signal input line 211 after the current becomes a steady value, the reference current for the first bit (MSB) is stored as a gate voltage of the transistor 201.

A Reference current is set through the above-mentioned steps. However, as a small current is leaked from the gate nodes of the drive transistors 201 to 203, the reference current needs to be set periodically (or non-periodically).

After the completion of setting the reference currents, digital voltage signals corresponding to video signals are inputted from the digital signal input lines 251 to 253. The digital signal input lines 251 to 253 correspond to a data input portion of the current output DA converter circuit 192. Since the DA switch transistors 261 to 263 are connected in parallel, the total current of the current sources of all the bits whose DA switches are in ON states is outputted from the output portion 282 in the end. In this manner, digital voltage data is converted into an analog current.

In the current output DA converter circuit 292 shown in FIG. 2, if there is variation in the drive transistors 202 to 203 in respect to electrical characteristics such as threshold voltages and electric field effect mobility, a display of a middle gradation may be inaccurate. However, by setting the reference current as above, both maximum gradation and middle gradation of MSB can be displayed accurately.

In the current output DA converter circuit 292 shown in FIG. 2, reference currents for 2-bit and 3-bit are set at the same time. Therefore, the setting is performed with a less complex manner than that in the circuit 792 shown in FIG. 7 in which a reference current for each bit has to be set individually.

Shown in FIG. 2 is an example of a DA converter circuit which reads in 3-bit digital voltage value data, and outputs analog current value data. However, in the case of reading in N-bit digital voltage value data (N is the arbitrary integer number not less than 2), the similar configuration can be employed.

The drive transistors 201 to 203 are n-channel types and the constant voltage source 281 is a low voltage source in the circuit shown in FIG. 2. However, the similar configuration can also be employed when the drive transistors 201 to 203 are p-channel types and 281 is a high voltage source. Furthermore, other configurations may also be employed as long as they include current output circuits comprising a plurality of drive transistors, wherein gate electrodes of the drive transistors are electrically connected to each other, and a switch is provided between the gate electrode and drain electrode of each drive transistor.

Furthermore, the place of the transistor 240 and a connected node of the capacitor 230 are not exclusively limited to the example shown in FIG. 2. For example, the example shown in FIG. 1 may be adopted as well. Voltages between the sources and drains of the drive transistors 202 to 203 have only to be stored when setting the reference currents.

In addition, in FIG. 2, reference currents for two bits are set with the same circuit configuration as FIG. 1, and a reference current for another bit is set independently. However, as for p-bit, the same configuration as in FIG. 1 may be adopted, and for q-bit, a reference current may be set independently (p and q are the arbitrary integer number not less than 2). Furthermore, as for x-bit, the same configuration as in FIG. 1 may be adopted, and for y-bit, the same configuration as in FIG. 1, but by the independent setting of the x-bit, may be adopted (x and y are the arbitrary integer number not less than 2).

At the outside of the panel, video data is processed most efficiently when the data is processed as digital voltage data. In this respect, the current output DA converter circuit 292 shown in FIG. 2 or 1835 shown in FIG. 12 in the current data output circuit in FIG. 12 serves for the data processing favorably.

However, when an analog current to be outputted is 0 or very small, it takes a long time to set a reference current by using the current output DA converter circuit shown in FIG. 2 only. In order to overcome this inconvenience, the current data output circuit 1842 may be additionally provided with a pre-charge circuit.

Described above is the current data output circuit 1842 which corresponds to the current data output circuit 512. cl Embodiment Mode 3

In this Embodiment Mode, examples of display devices and electronic apparatuses of the invention are described.

Given as examples of electronic apparatuses and display devices of the invention are monitors, video cameras, digital cameras, goggle type displays (head mounted displays), navigation systems, sound reproduction devices (audio components and car audios, etc.), notebook type personal computers, game machines, portable information terminals (mobile computers, mobile telephones, mobile type game machines, and electronic books, etc.), image reproduction devices equipped with recording mediums (specifically, devices equipped with displays capable of reproducing the recording mediums such as a Digital Versatile Disk (DVD), etc. and displaying the image thereof), and the like, and display devices mounted on these electronic apparatuses. Specific examples of these electronic apparatuses are shown in FIG. 6.

Figure 6A:
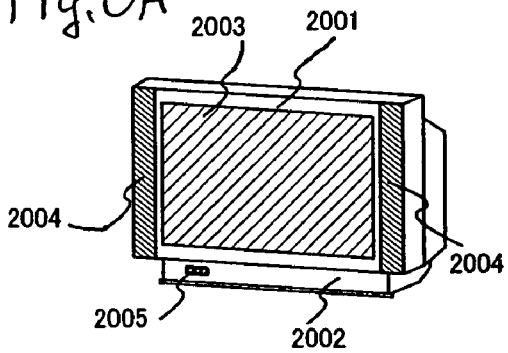
FIGS. 6A to 6H are views showing examples of a display device and an electronic apparatus of the invention.

FIG. 6A is a monitor including a frame 2001, a support base 2002, a display portion 2003, a speaker portion 2004, a video input terminal 2005, and the like. The display device of the invention can be used in the display portion 2003. Note that, monitors include various types of information display devices for personal computers, television broadcast receptions, and advertisement displays.

Figure 6B:
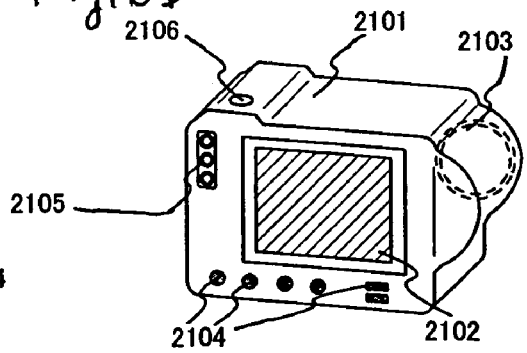

FIG. 6B is a digital still camera including a main body 2101, a display portion 2102, an image-receiving portion 2103, operation keys 2104, an external connection port 2105, a shutter 2106, and the like. The display device of the invention can be used in the display portion 2002.

Figure 6C:
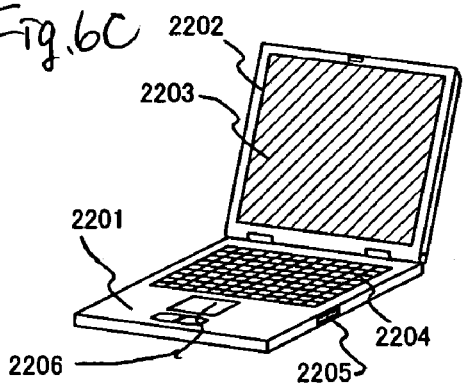

FIG. 6C is a notebook type personal computer including a main body 2201, a frame 2202, a display portion 2203, a keyboard 2204, an external connection port 2205, a pointing mouse 2206, and the like. The display device of the invention can be used in the display portion 2203.

Figure 6D:
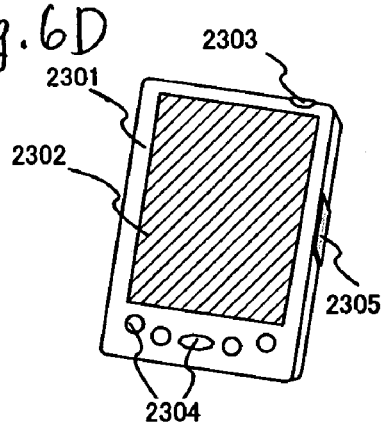

FIG. 6D is a mobile computer including a main body 2301, a display portion 2302, a switch 2303, operation keys 2304, an infrared port 2305, and the like. The display device of the invention can be used in the display portion 2302.

Figure 6E:
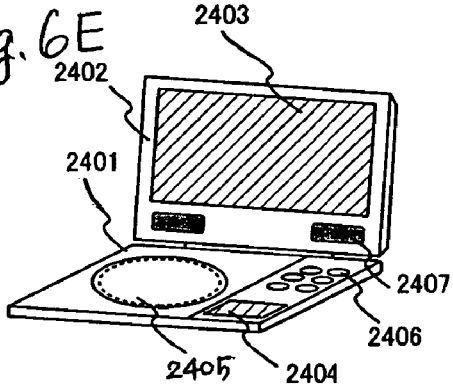

FIG. 6E is a portable image reproduction device provided with a recording medium (specifically, a DVD playback device) which includes a main body 2401, a frame 2402, a display portion A 2403, a display portion B 2404, a recording medium (such as a DVD) read-in portion 2405, operation keys 2406, a speaker portion 2407, and the like. The display device of the invention can be used in the display portions A 2403 and B 2404. Note that image reproduction devices provided with recording mediums include game machines for domestic use and the like.

Figure 6F:
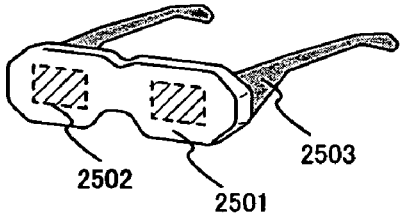

FIG. 6F is a goggle type display (head mounted display) including a main body 2501, a display portion 2502, an arm 2503, and the like. The display device of the invention can be used in the display portion 2502.

Figure 6G:
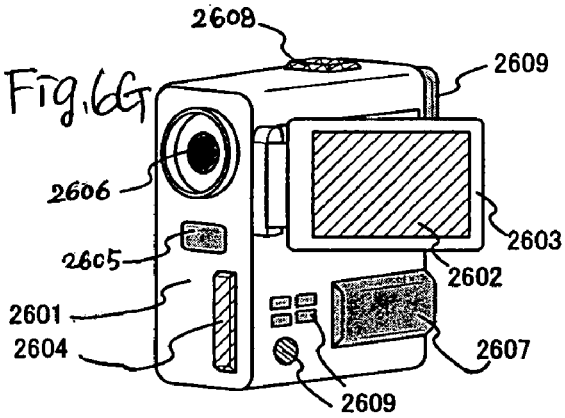

FIG. 6G is a video camera including a main body 2601, a display portion 2602, a frame 2603, an external connection port 2604, a remote control receiving portion 2605, an image receiving portion 2606, a battery 2607, an audio input portion 2608, operation keys 2609, an eyepiece portion

2610, and the like. The display device of the invention can be used in the display portion 2602.

Figure 6H:
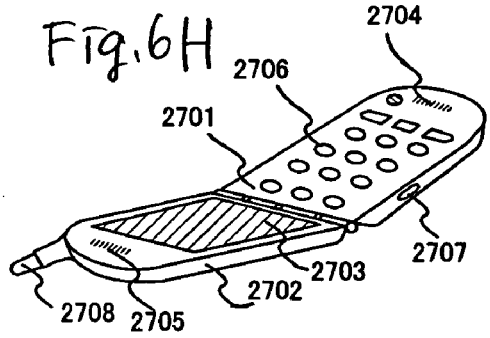

FIG. 6H is a mobile telephone including a main body 2701, a frame 2702, a display portion 2703, an audio input portion 2704, an audio output portion 2705, operation keys 2706, an external connection port 2707, an antenna 2708, and the like. The display device of the invention can be used in the display portion 2703. Note that, the power consumption of the mobile telephone can be suppressed by displaying white characters on a black background on the display portion 2703.

As described above, the application range of the invention is so wide that it can be used in electronic apparatuses of various fields.

What is claimed is:

1. A current output circuit comprising:

first and second drive transistors, wherein gate electrodes of the first and second drive transistors are electrically connected to each other;

a first switch provided between the gate electrode and a drain electrode of the first drive transistor; and a second switch provided between the gate electrode and a drain electrode of the second driver transistor.

2. A current output DA converter circuit comprising:

the current output circuit according to claim 1, wherein a switch whose ON/OFF operation is controlled corresponding to bit data is provided at each drain of the drive transistors of the current output circuit.

3. A display device comprising the current output DA converter circuit according to claim 2.

4. An electronic apparatus to which the current output DA converter circuit according to claim 2 is applied.

5. A current output DA converter circuit according to claim 2, further comprising:

a first DA switch connected to the first drive transistor and the first switch; and a second DA switch connected to the second drive transistor and the second switch.

6. A current output DA converter circuit comprising:

a plurality of current output circuits, one of which comprising:

a drive transistor, wherein a switch is provided between a gate electrode and drain electrode of the drive transistor, and other one of the current output circuits being the current output circuit according to claim 1.

7. A display device comprising the current output DA converter circuit according to claim 6.

8. An electronic apparatus to which the current output DA converter circuit according to claim 6 is applied.

9. A current output DA converter circuit according to claim 6, further comprising:

a first DA switch connected to the first drive transistor and the first switch; and a second DA switch connected to the second drive transistor and the second switch.

10. A display device comprising the current output circuit according to claim 1.

11. An electronic apparatus comprising the display device according to claim 10.

12. A current output circuit according to claim 1, wherein the current output circuit is used in an electronic apparatus selected from the group consisting of a monitor, a notebook type personal computer, a mobile computer, a portable image reproduction device with a recording medium, a goggle type display, a video camera, and a mobile telephone.

13. A current output circuit according to claim 1, wherein L/W size ratios of the first and second drive transistors are different from each other.

* * * * *